US006702165B1

(12) United States Patent
Ramirez

(10) Patent No.: US 6,702,165 B1
(45) Date of Patent: Mar. 9, 2004

(54) SUPPORT DEVICE FOR AN ELONGATED WEAPON

(76) Inventor: Leonard C. Ramirez, 1708 Hampton La., Daily City, CA (US) 94014

( * ) Notice: Subject to any disclaimer, the term of this patent is extended or adjusted under 35 U.S.C. 154(b) by 0 days.

(21) Appl. No.: 10/104,445

(22) Filed: Mar. 21, 2002

Related U.S. Application Data

(63) Continuation-in-part of application No. 09/813,061, filed on Mar. 20, 2001, now Pat. No. 6,497,349.

(51) Int. Cl.[7] ..... B65D 39/08; B65D 25/04

(52) U.S. Cl. ..... 224/199; 224/200; 224/674; 224/245; 224/251; 224/914; 224/915

(58) Field of Search ..... 224/197, 199, 224/200, 671, 674, 243, 242, 245, 251, 914, 915

(56) References Cited

U.S. PATENT DOCUMENTS 755,009 A * 3/1904 Igel ..... 224/250
1,894,540 A * 1/1933 Peirce ..... 224/242
2,956,715 A * 10/1960 Henderson ..... 224/245
3,384,277 A * 5/1968 Hodelka ..... 224/242
3,700,147 A * 10/1972 Vaughn ..... 224/149
4,588,116 A * 5/1986 Litman ..... 224/672
4,830,247 A * 5/1989 Banks ..... 224/666
4,951,857 A * 8/1990 Carr ..... 224/230
4,955,518 A * 9/1990 Parsons et al. ..... 224/247
5,232,137 A * 8/1993 Devine ..... 224/666
5,772,089 A * 6/1998 Parsons et al. ..... 224/251
5,803,325 A * 9/1998 Wang ..... 224/275
6,059,157 A * 5/2000 Parsons et al. ..... 224/251

* cited by examiner

*Primary Examiner*—Stephen K. Cronin
(74) *Attorney, Agent, or Firm*—Theodore J. Bielen, Jr.

(57) ABSTRACT

A support device for an elongated weapon which is connectable to a belt. The support includes a housing having a bottom and a wall portion extending from the bottom along the dimension of elongation of the weapon. The wall portion forms an open chamber for accommodating the weapon and positioning the elongated weapon in an upright manner with the weapon resting on the bottom of the housing. A clamp releasably secures a portion of the elongated weapon in the upright manner, but is removed with a force applied outwardly from the housing. A slot is formed in the wall portion and extends along the majority of the dimension of elongation of the weapon.

9 Claims, 9 Drawing Sheets

SUPPORT DEVICE FOR AN ELONGATED WEAPON

CROSS-REFERENCE TO RELATED APPLICATIONS

The present application is a Continuation-in-Part of patent application Ser. No. 09/813,061, filed Mar. 20, 2001 now U.S. Pat. No. 6,497,349.

BACKGROUND OF THE INVENTION

The present invention relates to a novel and useful support or holster for an elongated weapon.

Police and security forces are often required to carry weapons such as batons or nightsticks in the line of duty. These elongated weapons are normally carried in a sheath or loop connected to a belt which surrounds the peace officer. In certain cases, loops or tabs hold the weapon in the sheath or holster to prevent the same from being freed unexpectedly when the peace officer is moving.

One such weapon is found in U.S. Pat. No. 5,454,656 depicts an elongated type weapon which is typically used by enforcement personnel.

In the past, sheaths and holsters, although satisfactory in holding elongated type weapons, often prevent the immediate access to such weapons when needed. That is to say, elongated weaponds such as Yawara sticks, nightsticks, batons, and the like must be drawn to the ready in immediate fashion.

The device for storing and permitting ready access to an elongated weapon would be a notable advance in the law-enforcing field.

BRIEF SUMMARY OF THE INVENTION

In accordance with the present invention a novel and useful support device for an elongated weapon is herein provided.

The support device of the present invention utilizes a housing having a bottom and a wall portion which extends from the bottom. The housing is shaped such that the wall portion follows the dimension of elongation of the elongated weapon. In this manner, the wall portion forms an open chamber for accommodating the elongated weapon permitting positioning of the weapon in an upright manner. The weapon rests on the bottom of the housing within the chamber of the housing. The housing may be manufactured of any suitable material such as plastic, metal, wood, composite compounds, and the like.

A slot is formed in the wall portion of the housing and extends along most of or a majority of the dimension of elongation of the elongated weapon in order to permit removal of the weapon from the housing. In other words, when the weapon is drawn or removed, it passes through the slot in the wall portion of the housing. The slot may include a shortened wall portion or may extend directly to the bottom of the housing. Also, the slot may be oriented such that a force away from the belt or the user of the weapon must be applied to a certain degree in order to remove the weapon. Such force would be in contrast to a tangent force. The slot, of course, would be oriented such that it faces outwardly from the belt or user of the weapon to a certain degree.

A clamp is also employed in the present invention for releasably securing a portion of the elongated weapon positioned in an upright manner within the housing. The clamp is capable of releasing the weapon for removal from the housing upon the application of prior mentioned force on the weapon outwardly from the housing. Again, when the slot is angled away from the belt or user, such force would have a component which vectors outwardly from the belt or from the user of the weapon.

A wall portion adjacent the slot is found in the embodiment of the invention, a lip may be formed to offer some support to the weapon, also, the wall portion adjacent the slot is formed as a continuation of the slot and may be skewed to further ease the removal of the weapon without resistance from the housing structure.

In addition to the structure of the device hereinabove described, a strap may be used to surround the weapon. Such strap may extend from the belt and include fastening means for releasably holding the same in such surrounding relationship relative to the weapon.

Moreover the structure of the device of the present application may include a sheath which is capable of supporting a baton or similar weapon. The support for the baton is provided by a rim of the sheath which engages an enlarged portion of the baton. Also, the sheath may include a clamp which releases the weapon upon the application of an outward force. The sheath is capable of pivoting to allow the person supporting the weapon to assume various positions such as standing, sitting, kneeling, and the like. Such pivoting may further include a releasable lock to permit assumption and release from certain radial orientations.

Further, the structure of the support apparatus may be formed first and second end portions as a open sheath. The first end portion terminates in a rim while the second end portion possesses a pair of mitred edges.

It may be apparent that a novel and useful support device for an elongated weapon has been hereinabove described.

It is therefore an object of the present invention to provide a support device for an elongated weapon which secures the weapon to the belt of a user and permits the quick release of the weapon for use.

Another object of the present invention is to provide a support device for an elongated weapon which includes a clamp mechanism that releases the weapon from a housing by the use of an outward force relative to the housing.

A further object of the present invention is to provide a support device for an elongated weapon which is compatible with weapon carrying paraphernalia normally used by law enforcement personnel.

Another object of the present invention is to provide a support device for an elongated weapon which is easily attachable to a belt employed by law enforcement personnel.

Another object of the present application is to provide a support device for a weapon which is capable of accommodating weapons of different sizes.

A further object of the present application is to provide a support device for a baton weapon which may be used with baton weapons of different configurations.

Another object of the present invention is to provide a support device for an impact weapon which includes means for rotating a sheath relative to a carrying belt and selectively locking or releasing the sheath in its rotational movement.

Another object of the present invention is to provide a support device for an impact weapon which includes a sheath having a structure which greatly minimizes resistance to removal of the impact weapon from the sheath.

The invention possesses other objects and advantages especially as concerns particular characteristics and features thereof which will become apparent as the specification continues.

For a better understanding of the invention reference is made to the following detailed description of the preferred embodiments thereof which should be referenced to the prior described drawings.

DETAILED DESCRIPTION OF THE PREFERRED EMBODIMENTS OF THE INVENTION

Various aspects of the present invention will evolve from the following detailed description of the preferred embodiments which should be taken in conjunction with the hereinbefore-referenced drawings.

Figure 1:
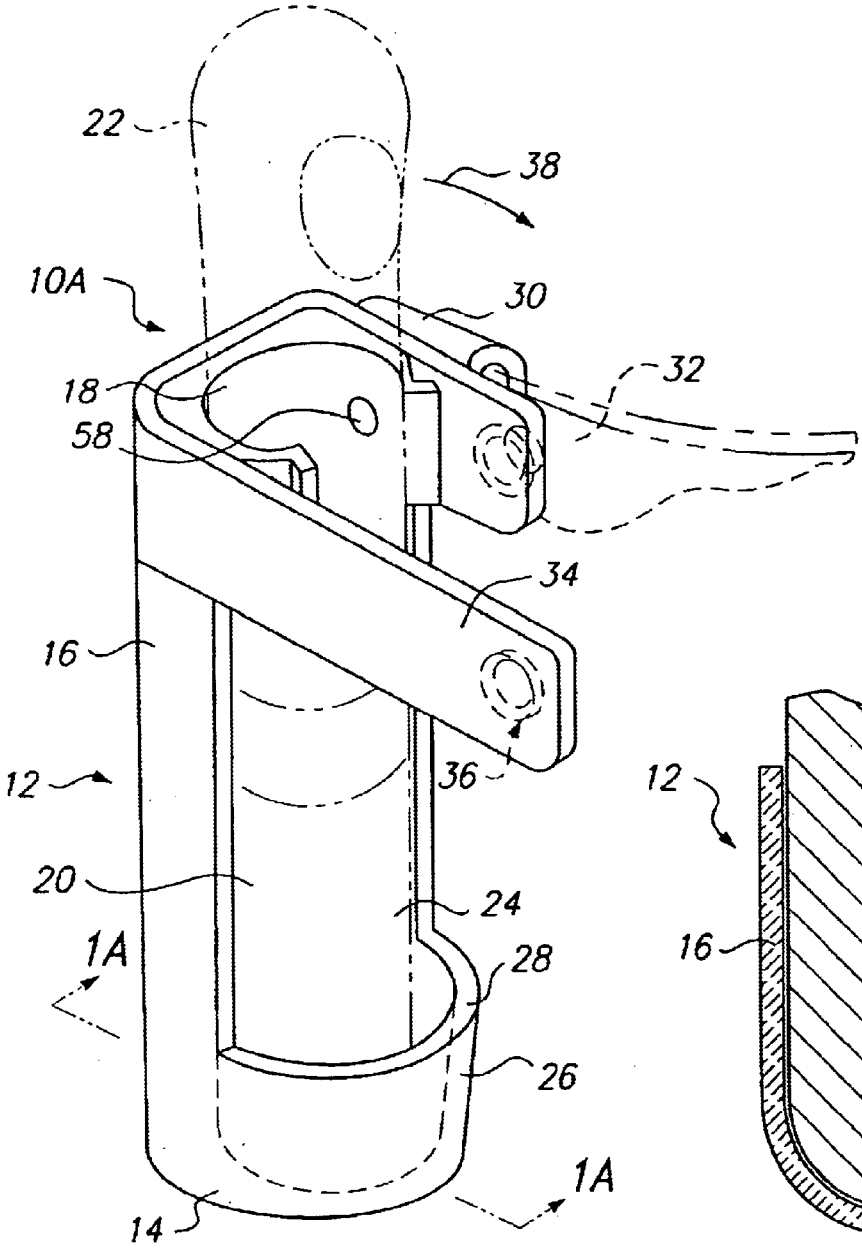
FIG. 1 is a top left side perspective view of an embodiment of the present invention in use with a belt and an elongated weapon shown in phantom.

The invention as a whole is shown in the drawings by reference character 10 and an upper case letter to denote various embodiments of the same. FIG. 1 shows embodiment 10A of the present invention where a housing 12 is depicted. Housing 12 includes a bottom 14 which is rounded. Wall portion 16 extends upwardly from bottom 14 and terminates in an upper opening 18. Housing wall portion 16 and bottom 14 forms an open chamber 20 for accommodating an elongated weapon 22 such as that depicted in U.S. Pat. No. 5,454,565. As shown in FIG. 1, weapon 22 is elongated and rests in an upright manner within chamber 20 of housing 2. Specifically, weapon 22 rests on bottom 14 of housing 12.

Figure 1A:
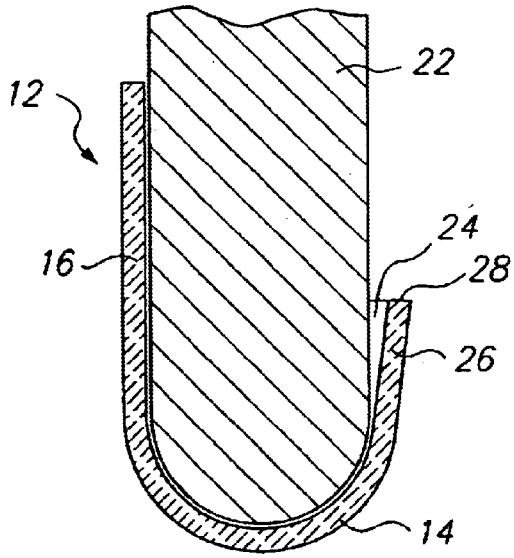
FIG. 1*a* is a sectional view taken along line 1*a*—1*a* of FIG. 1.

Housing 12 is constructed with a slot 24 formed in wall portion 16. Slot 24 extends along a majority of the dimension of elongated weapon 22. In the embodiment 10A depicted in FIG. 1, wall portion 16 possesses a shortened portion 26 having a lip 28 at its terminus. With reference to FIG. 1A, it may be observed that shortened portion 26 of wall portion 16 is skewed or angled outwardly when compared to the remaining part of wall portion 16. In this manner, weapon 22 is easily removed from chamber 24 of housing 12.

Returning to FIG. 1, it may be observed that device 10 includes a loop 30 which accommodates a belt or webbing 32 normally encircling the waist of the user. Strap 34 extends from loop 30 and belt 32 and encircles weapon 22 when closed. Fastening means 36 in the form of male and female snaps serves to releasably hold strap 34 in a surrounding relationship relative to weapon 22. Directional arrow 38 indicates the movement of the force which would be required to move weapon 22 from chamber 24 of housing 12 for use.

Figure 2:
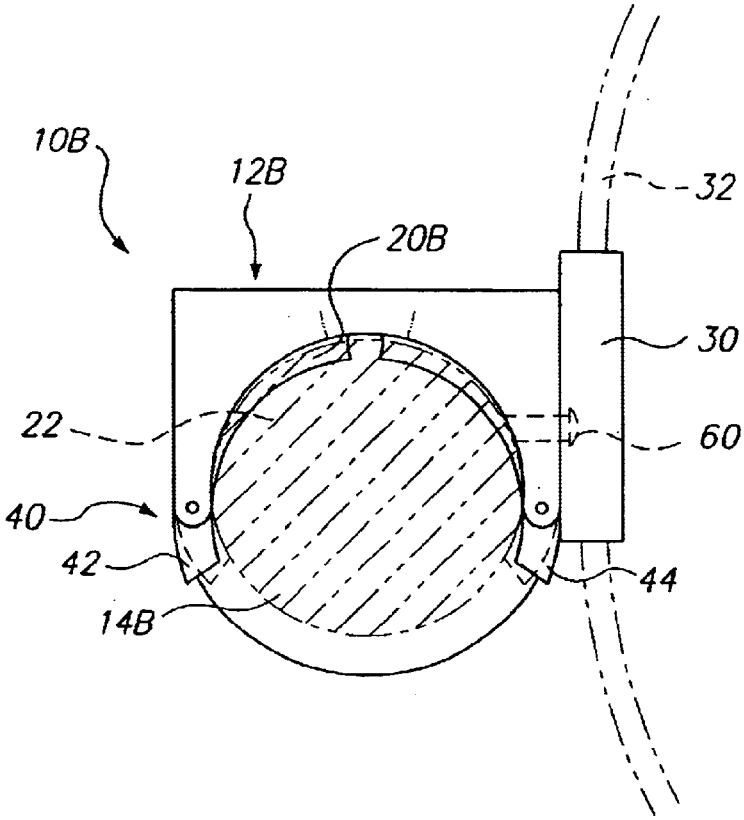
FIG. 2 is a top plan view of an embodiment of a clamp used in conjunction with a device of the present invention.
Figure 3:
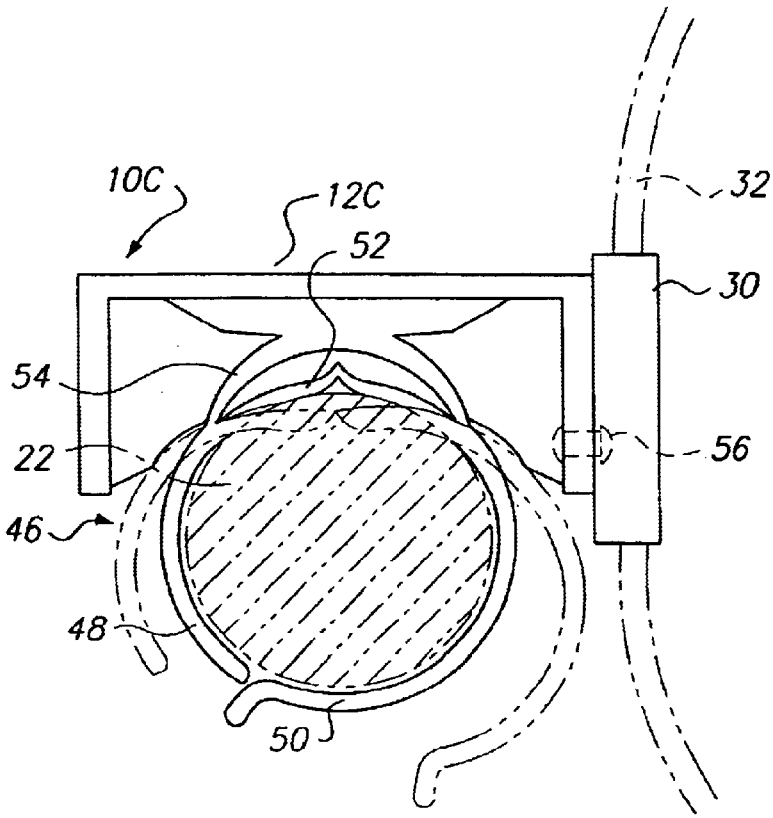
FIG. 3 is a top plan view of another clamp useable with the device of the present invention.

Turning to FIGS. 2 and 3, it may be observed that embodiments 10B and 10C are shown of the present invention. Embodiment 10B includes a housing 12B having a bottom 14B forming a chamber 20B. Weapon 22 is supported in an upright position as that shown in FIG. 1, but includes the addition of a clamp 40 to retain weapon 22 in such position. Clamp 40 includes a pair of jaws 42 and 44 but snap open when weapon 22 is pushed away from housing 12B. Such clamp is commercially available and known in the art.

FIG. 3 shows a similar embodiment as that depicted in FIG. 2 except that a clamp 46 of a different configuration is employed. Clamp 46 includes arms 48 and 50 which are sprung open when weapon 22 is dislodged according to directional arrow 38 on FIG. 1. Arms 48 and 50 are connected to a flexible wishbone base 52 which itself is connected to a flexible yoke 54. Rivet 56 holds housing 12C to loop 30 as does rivet 58 with respect to embodiment 10A. Again, rivet 60 performs the same function with respect to embodiment 10B.

Figure 4:
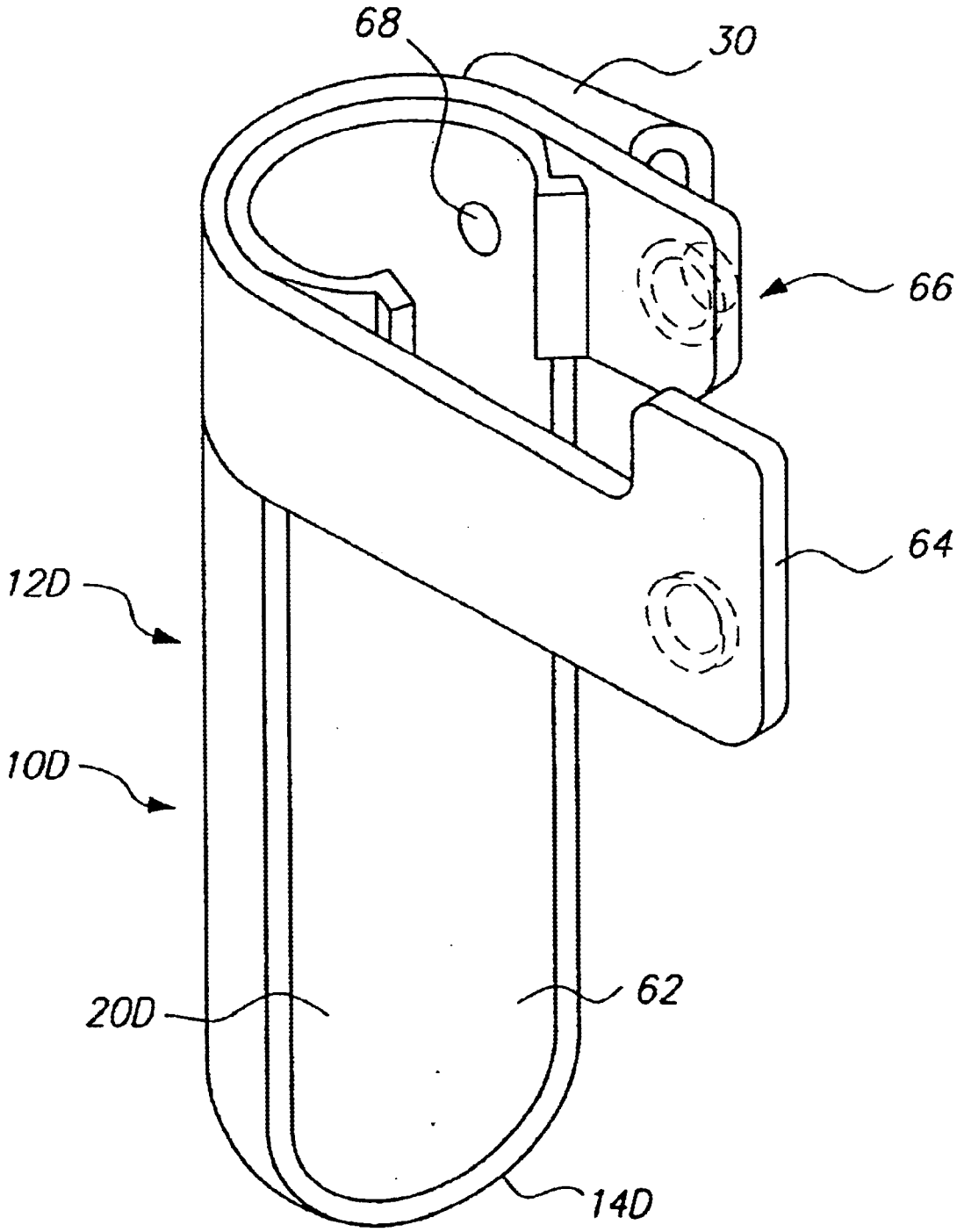
FIG. 4 is a top, left side, perspective view of another embodiment of the device of the present invention.

Turning now to FIG. 4, another embodiment 10D of the device of the present invention is shown. 10D includes a housing 12D having a bottom 14D slot 62 extends the entire length of housing 12, eliminating a shortened wall portion 26 of the type shown in embodiment 10A. Strap 64 again surrounds housing 12D and fastens in such surrounding relationship by the use of snap members 66. Rivet 68 holds housing 12D to loop 30. Thus, a weapon such as weapon 22 would be held in an upright position in a chamber 20D by strap 64.

Figure 5:
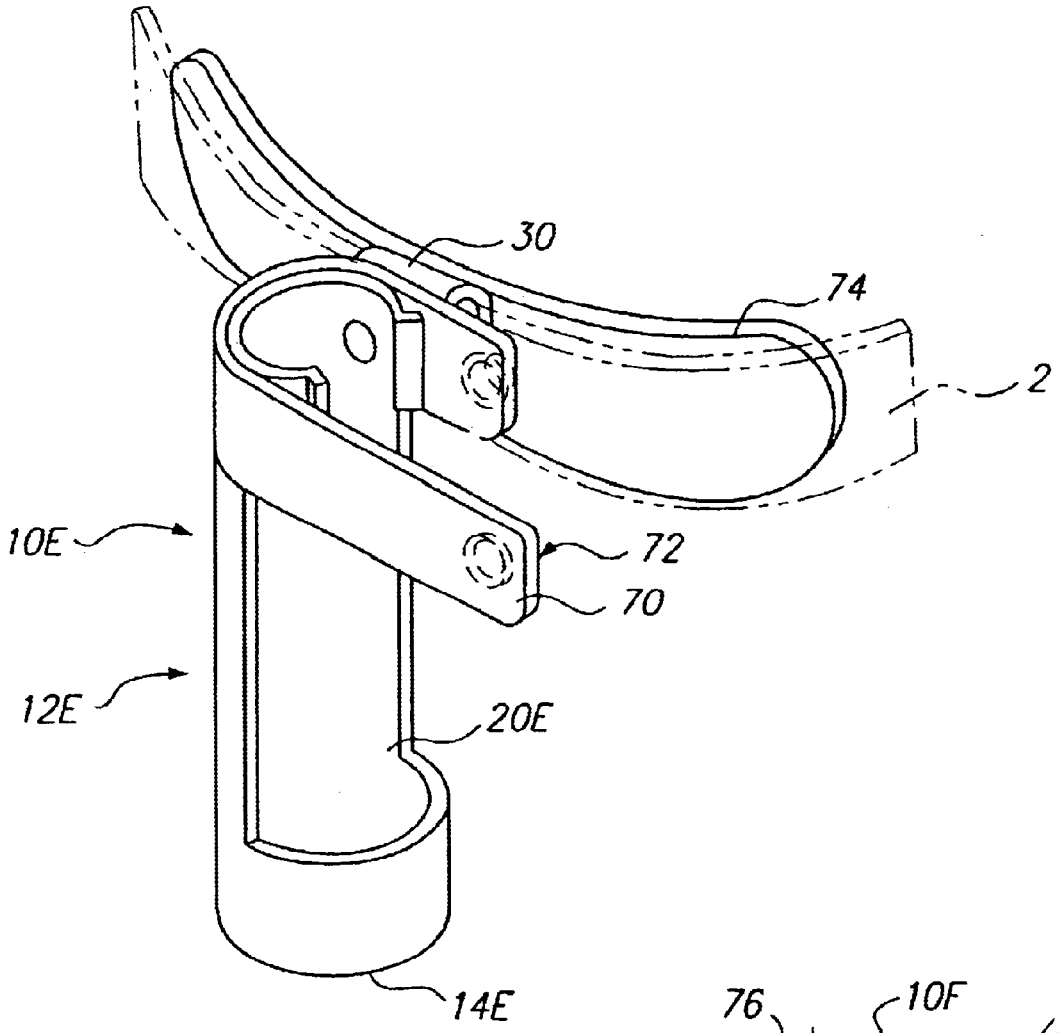
FIG. 5 is a top, left side, perspective view of a further embodiment of the present invention.

FIG. 5 shows embodiment 10E of the present invention in which a housing 12E includes a chamber 20E having a bottom 14E. Strap 70 and snap member 72 releasably surround and hold a weapon such as weapon 22 placed in chamber 20E. Adjacent loop 32 a shield or partition 74 is placed which further supports device 10E behind belt 32.

Figure 6:
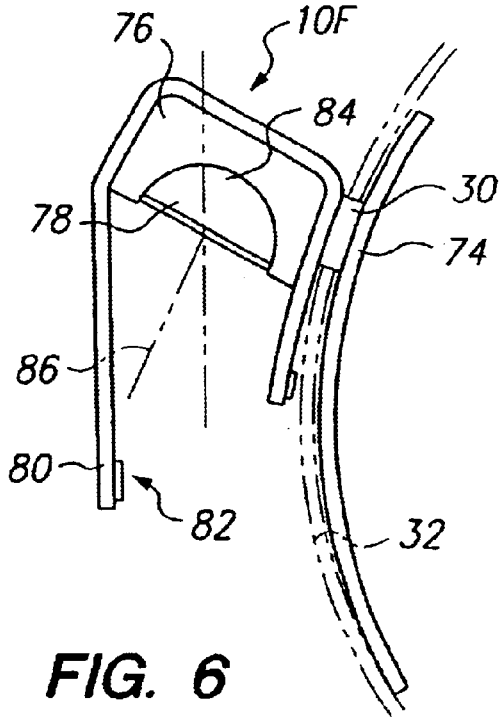
FIG. 6 is a top plan view of an embodiment of the present invention illustrating a skewed slot in the housing portion thereof.

Embodiment 10F of FIG. 6 is depicted in which a housing 76 is shown having a slot 78 that is oriented outwardly from belt 32. Strap 80 and snap fasteners 82 are intended to hold a weapon 22 in releasable fashion if weapon 22 were placed in chamber 84 of housing 76. The force required to remove weapon 22 from chamber 84 would lie along axis 86, which includes a component that extends outwardly from belt 32, in addition to the tangential force normally required with the prior embodiments.

Figure 7:
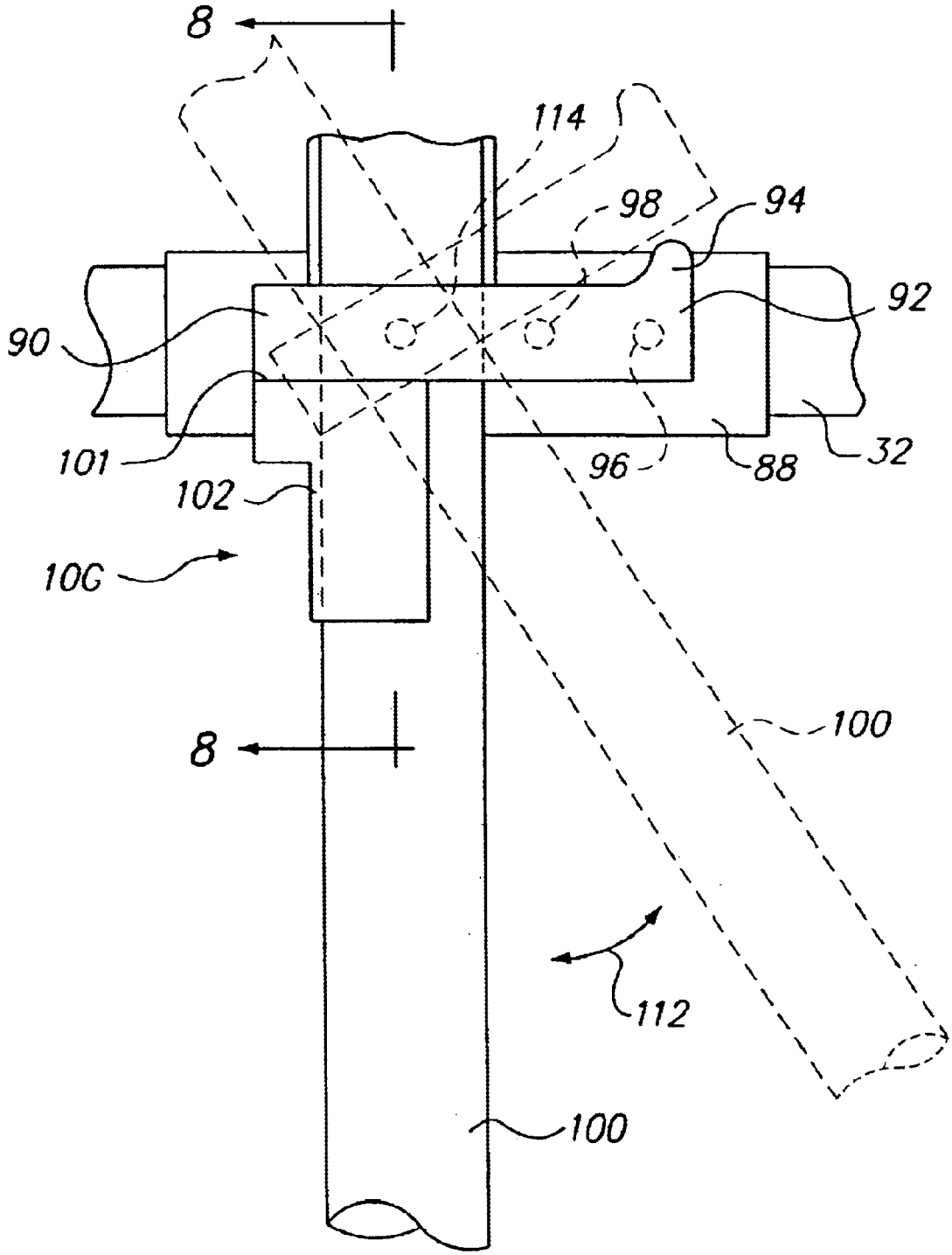
FIG. 7 is a side elevational view of another embodiment of the present application with a depiction of the rotational motion of the sheath.
Figure 8:
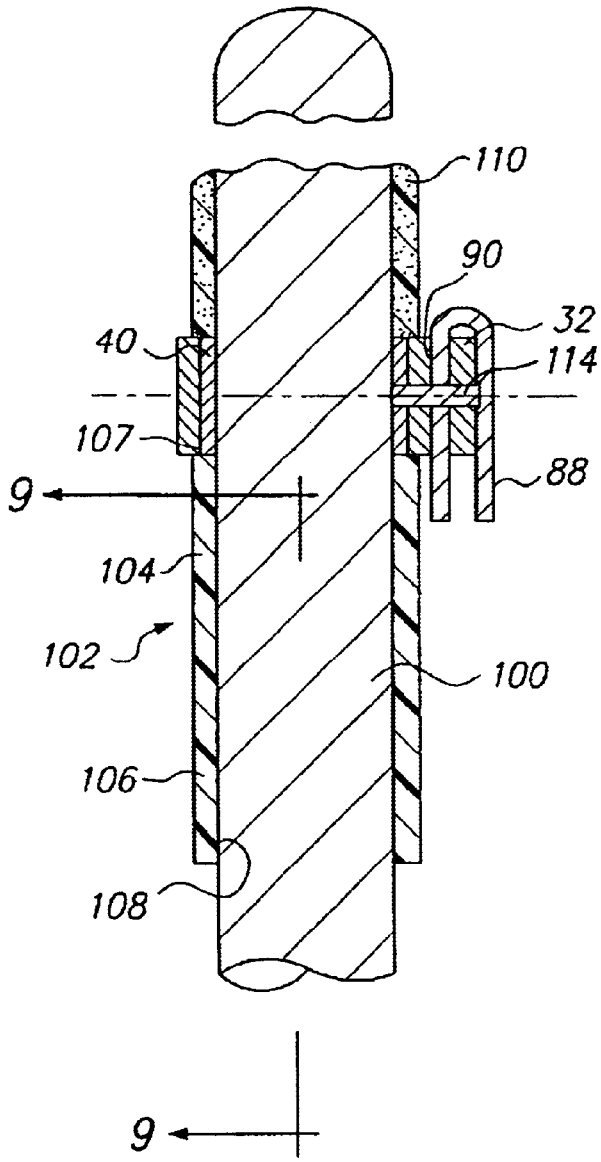
FIG. 8 is a sectional view taken along line 8—8 of FIG. 2.
Figure 9:
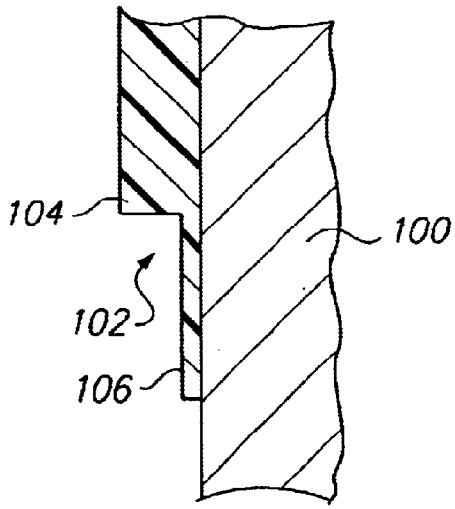
FIG. 9 is a sectional view taken along line 9—9 of FIG. 3.

With respect to FIGS. 7–9, embodiment 10G of the present invention is depicted. Embodiment 10G is used in conjunction with belt 32 of embodiments 10A–F. In addition, a hip support 88 loops over belt 32 as shown in FIGS. 7 and 8. It should be noted, that hip support 88 may include a closed aperture which would require the threading of belt 32 therethrough. Strap 90 lies against hip support 88 and includes a releasable end portion 92 having a thumb tab 94 to facilitate movement of the same. Snap mating pairs 96 and 98 are found on strap 90 in a manner similar to that depicted in FIG. 1 with respect to fastening means 36.

Support 10G is intended to be employed with elongated weapons of varying sizes, such as batons, nightsticks, collapsible batons, and the like. For example, full-length baton 100 is shown as being employed with support 10G. In this regard, support 10G includes a sheath 102. Sheath 102 possesses an upper portion 104 and a lower portion 106. Upper portion 104 and lower portion 106 of sheath 102 includes a common inner wall 108. Inner wall 108 is intended to at least partially rest against baton 100. Upper portion 104 is thicker in cross-sectional configuration than portion 106 to support clamp 40 and strap 90 against impact forces. It should be noted that clamp 40 rides on rim 107 of upper portion 104 of sheath 102, but may be constructed to lie within sheath 102 against an extension of inner wall 108. Baton 100 may be formed with a gripping member or grommet 110 such that the upper edges of clamp 40 and belt 90 would contact grommet 110 to gain additional support for baton 100 within sheath 102, in addition to that afforded by clamp 40.

Returning to FIG. 1, and viewing FIG. 8, it should be realized that baton 100 is capable of rotating about axis 113according to directional arrow 112 such rotation is due to rivet 114 which extends through belt 32, hip support 88, strap 90, and clamp 40. Such rotation would allow the person using support 10G with a long baton 100 to assume other positions such as kneeling or sitting.

Figure 10:
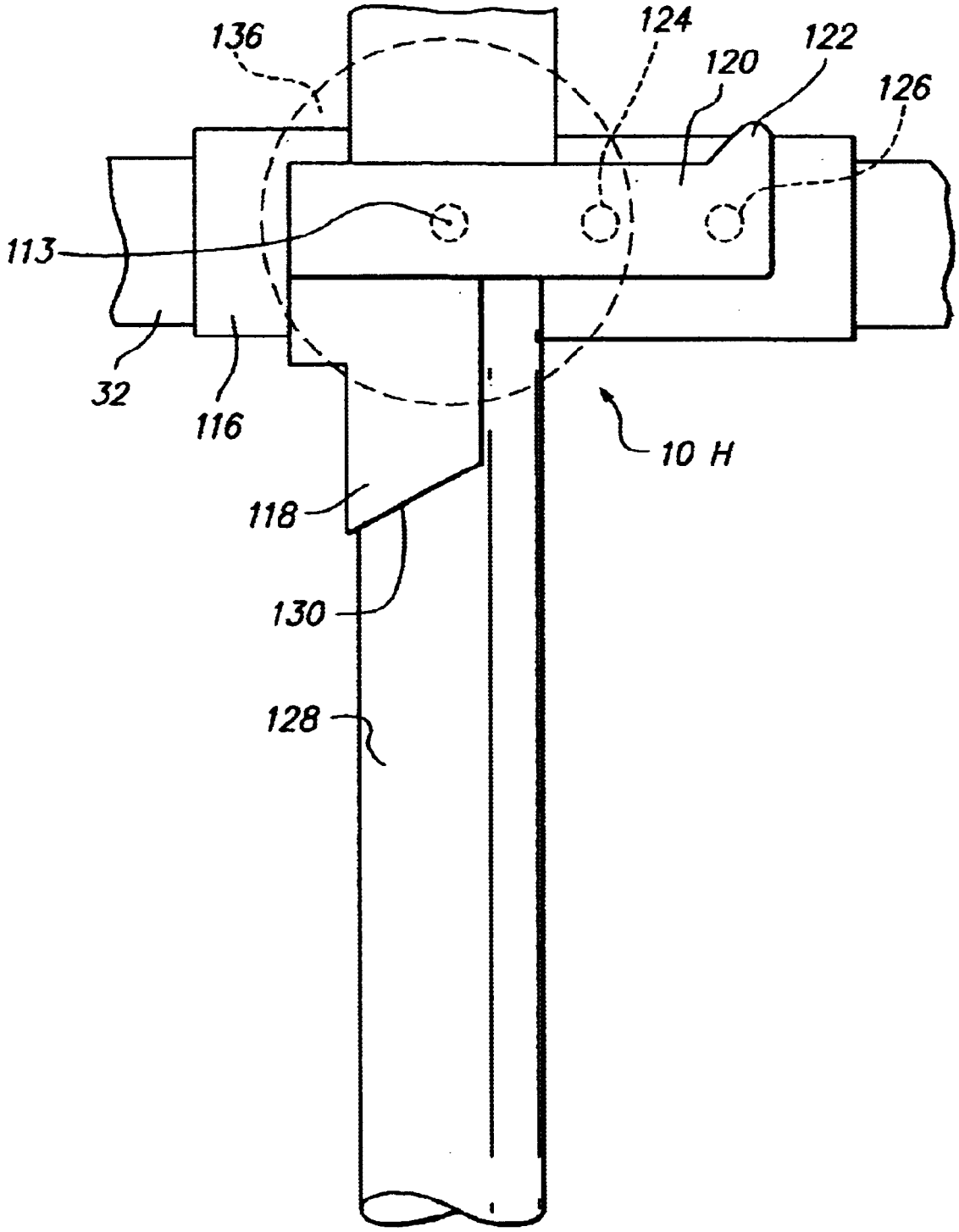
FIG. 10 is a partial, side elevational view of embodiment of the present invention.
Figure 11:
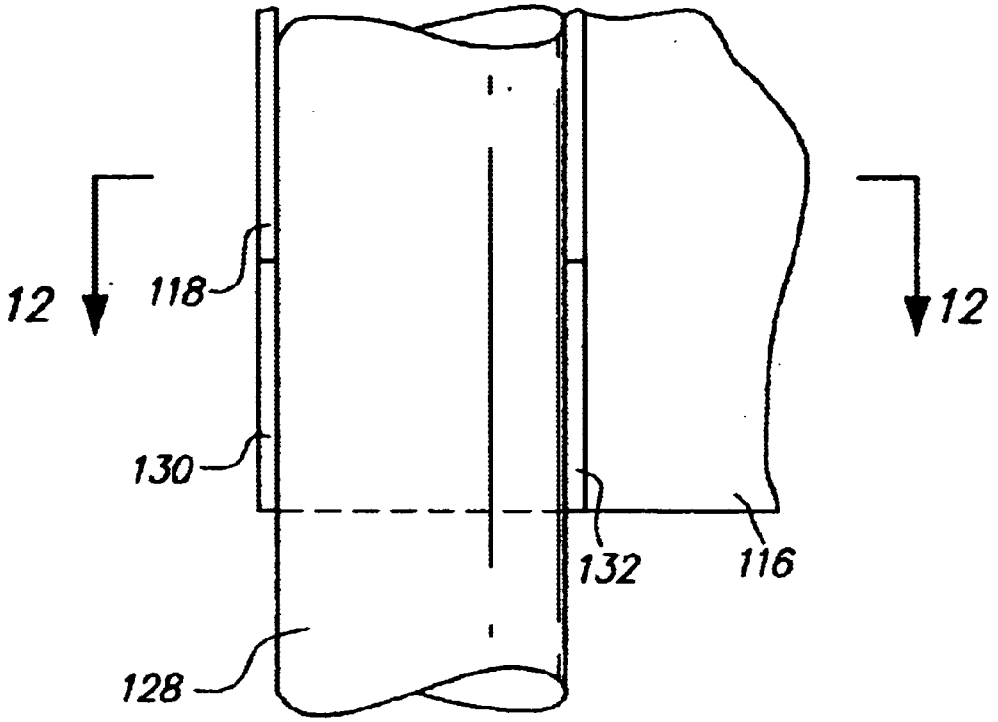
FIG. 11 is a partial front elevational view of the embodiment of FIG. 10.
Figure 12:
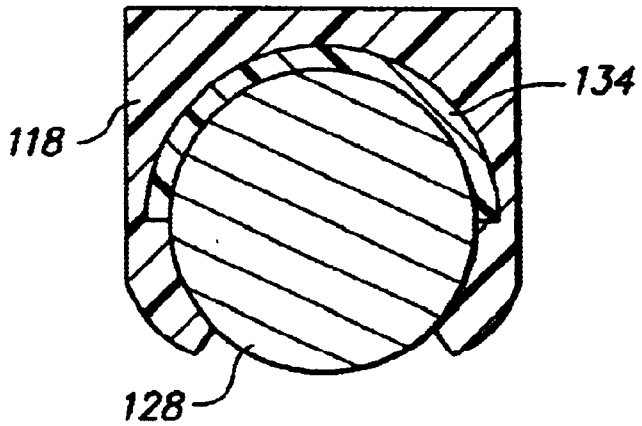
FIG. 12 is sectional view taken along line 12—12 of FIG. 11 of the sheath portion only.

With reference to FIG. 10, embodiment 10H is depicted. Device 10A includes a loop 116 which extends along belt 32. Sheath 118 is fixed to loop 116 in the same manner as sheath device 10 of FIG. 1. Strap 120 extends around sheath 118 and terminates in a tab 122 to permit the easy removal of the same. Snaps 124 and 126 (shown in phantom) are the same as fastening means 36 depicted in FIG. 1. Long baton 128 is illustrated as lying within sheath 118, FIGS. 10–12, and extending downwardly from the lower portion of sheath 118. Mitred edges 130 and 132 provide the lower terminous of sheath 118 and minimize resistance to removal of baton 128 from sheath 118. In addition, insert 134 is formed of a reduced friction material such as plastic to aid in removal of baton 28 from sheath 118. Of course, the clamping mechanisms depicted in the prior embodiments 10A–10G may also be employed in the sheath depicted in FIGS. 10–12.

Figure 13:
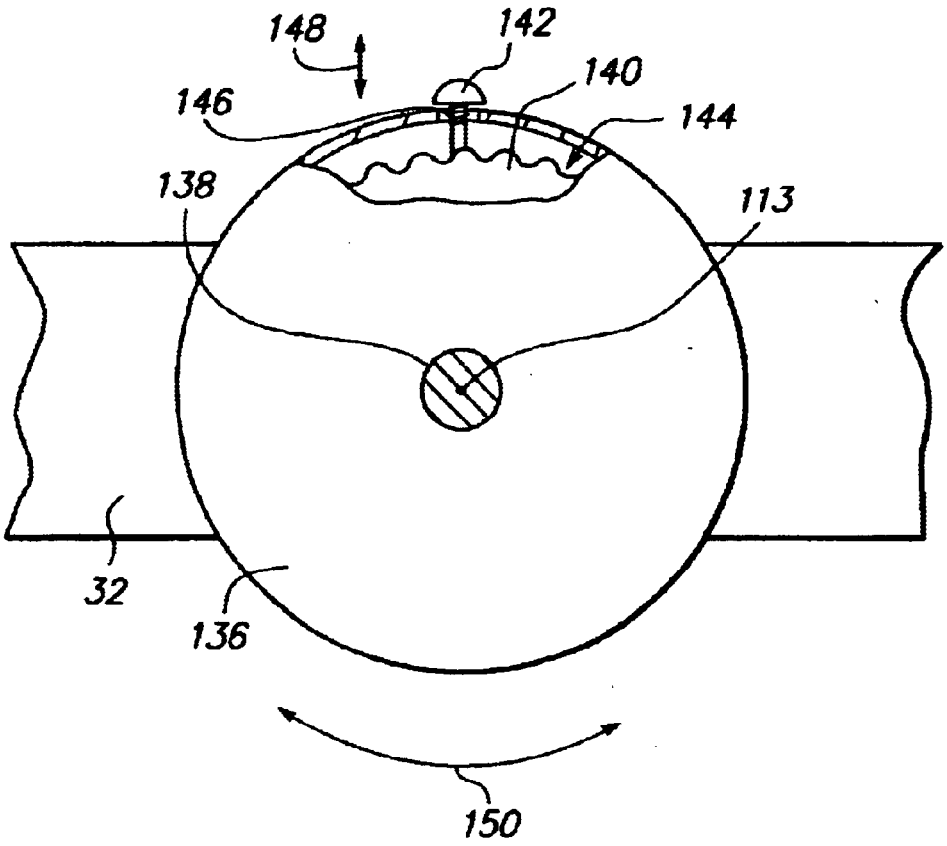
FIG. 13 is a side elevational view of a releasable ratchet mechanism and with the sheath of the present invention.
Figure 14:
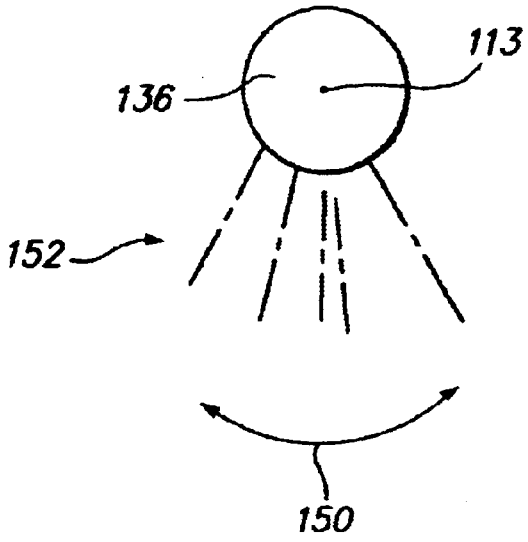
FIG. 14 is a schematic view depiction of the rotational movement of the ratchet mechanism shown in FIG. 13.

Referring now to FIGS. 13 and 14, a ratchet mechanism 136 may be used with embodiment 10H of the present invention. FIG. 10 represents ratchet mechanism 136 in phantom as being located between loop 116 and strap 120 used with sheath 118. In any case, a rotational pin 138 rotates about axis 113. Of course, pin 138 is connected to belt 32 and strap 120 of embodiment 10H. Ratchet wheel 140 rotates about axis 113 within ratchet mechanism 136. Detent button 142 is capable of engaging any of the plurality of grooves 144 within ratchet wheel 140. Spring mechanism 146 holds detent button 142 in plurality of grooves 144 yet permits removal of detent button 142 by pulling upwardly of the same. Of course, other detent mechanisms may be employed such as ones releasing detent 142 by pressing the same inwardly. Directional arrow 148 indicates the upward and downward movement of detent button 142 in this regard. Directional arrow 150 illustrates the rotational movement of ratchet 136 about axis 113, as well as the rotational movement of baton 128. FIG. 14 represents a plurality of axial orientations 152 of baton 128 about ratchet 136. That is to say, baton 128 may be rotated into a fixed position about axis 113 and easily released from that position to accommodate use of long baton 128 during walking, sitting, bike riding and other activities in which a peace officer may engage.

In operation, the user fastens any one of the devices 10A–10E to a belt 32 by the use of loop 30. Weapon 22 is placed in the chamber of any of the housings of any of the embodiments above described. For example, with respect to embodiment 10A weapon 22 is placed in chamber 20 of housing 12 to lie on bottom portion 14. Strap 34 releasably holds weapon 22 in an upright position by the interaction of snaps 36. To release and remove weapon 22, a force is applied along directional arrow 38 after strap 34 is unfastened. Slot 24 of housing 12, as well as the slots of the other embodiments, permits the easy removal of weapon 22 for use. It should be noted that embodiment 10E requires a slightly different force, somewhat outwardly, to remove weapon 22, because slot 28 is oriented slightly outwardly. Thus, the embodiments found in devices 10–10E support an elongated weapon in an upright position and allow the easy removal of the same by a forward or outward force, obviating the need for pulling the weapon from a sheath or loop found in the prior art.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A support apparatus for an elongated weapon the apparatus being connectable to a belt, comprising:

a. a sheath, said sheath having a wall portion forming a recess at least partially surrounding the elongated weapon, said wall portion including a first end portion terminating in a rim and a second end portion terminating in an opening for the elongated weapon, said wall portion second end portion possessing a pair of mitred edges;

b. a clamp supported within said sheath, said clamp releasably securing a portion of the elongated weapon upon the application of a force on the weapon outwardly from said recess of said sheath; and c. means for supporting said sheath to the belt.

2. The apparatus of claim 1 in which said sheath wall portion lies in contact with a portion of said elongated weapon.

3. The apparatus of claim 1 which additionally comprises means for rotating said apparatus relative to the belt.

4. The apparatus of claim 1 which further comprises means for selectively locking said rotation of said apparatus relative to the belt.

5. A support device for an elongated impact weapon connectable to a belt, comprising:

a. a housing having a bottom and a wall portion extending from said bottom along the dimension of elongation of the elongated impact weapon, said wall portion forming an open chamber for accommodating the elongated impact weapon and positioning the elongated impact weapon in an upright manner with the elongated impact weapon resting on the bottom of said housing, said housing being connectable to the belt at a predetermined place of attachment;

b. a clamp releasably securing a portion of the elongated impact weapon in said upright manner, said clamp releasing the elongated impact weapon for removal from said housing on the application of a force on the elongated impact weapon outwardly from the housing; and c. a slot formed in the wall portion of said housing, said slot extending along a majority of the dimension of elongation of the elongated impact weapon to permit removal of the elongated impact weapon from said housing, said slot being oriented to face outwardly from the belt along an axis angularly disposed relative to an axis tangential to the belt and passing through the predetermined place of attachment of said housing to the belt.

6. The device of claim 5 in which said clamp further releasably secures a portion of the elongated impact weapon in said upright manner immediately adjacent said wall portion and in opposition to said slot.

7. The device of claim 5 in which said wall portion includes a lip adjacent said slot, said lip being the termination of a part of said wall portion skewed relative to the remaining part of said wall portion.

8. The device of claim 5 which additionally comprises a strap extending from the belt and surrounding the elongated impact weapon.

9. The device of claim 8 which additionally comprises fastening means for releasably holding said strap in surrounding relationship to the elongated impact weapon.

* * * * *